US005178573A

United States Patent [19]

Smith

[11] Patent Number: 5,178,573

[45] Date of Patent: Jan. 12, 1993

[54] MAGNETIC DOLL SET

[76] Inventor: Helen Smith, Box 346, Dollar Bay, Mich. 49922

[21] Appl. No.: 709,310

[22] Filed: Jun. 3, 1991

[51] Int. Cl.[5] ..... A63H 3/08; A63H 33/26

[52] U.S. Cl. ..... 446/73; 446/98; 446/139

[58] Field of Search ..... 446/137, 139, 98, 129, 446/92, 73; 434/168, 170, 211

[56] References Cited

U.S. PATENT DOCUMENTS

| | | | |
|---|---|---|---|
| 1,879,002 | 9/1932 | Alles | 446/137 X |
| 3,093,919 | 6/1963 | Holtz | 446/137 X |
| 3,316,669 | 5/1967 | Nachbar | 446/98 X |
| 4,846,689 | 7/1989 | Day | 434/211 X |

*Primary Examiner*—Mickey Yu

*Attorney, Agent, or Firm*—Ralph S. Branscomb

[57] ABSTRACT

The doll set utilizes a ferromagnetic backing panel such as a thin sheet of steel, a representation of a human figure such as a little girl, and a series of clothing and other accessories which are applied over the representation of the human figure. The human figure can either be applied by printing to paper lying over the front of the ferromagnetic backing panel or it can be cut from a planar sheet of magnetic material, to be magnetically adhered to the steel sheet. The clothing and accessories are cut out of semi-flexible, ceramic magnetic material, and may be covered with printed paper, or textured cloth, to be temporarily magnetically bonded to the figure of the doll over the steel sheet, so that the child playing with the set can interchange outfits for the doll at will, and have a convenient place to keep the outfits that are not currently in use.

3 Claims, 1 Drawing Sheet

MAGNETIC DOLL SET

BACKGROUND

Playing with dolls is a favorite preoccupation with children, especially girls, it is very instrumental in working the child's imagination, as opposed to watching television or other passive activities which require no positive action on the part of the child. Doll play no doubt goes back for millennia. In recent years, toy companies have seized upon the popularity of dolls with little girls to produce an unending sequence of new dolls with advanced features, such as wetting their diapers, drinking milk from a bottle, crying, and otherwise acting like a baby. These dolls tend to be quite high-priced, and whereas they may or may not detract from the imagination required to work with them because of their built-in features, they probably do not add anything.

One problem with dolls is that the principle activity that children engage them in is dressing and undressing. For example, the BARBIE doll (tm) has dozens of different outfits for playing tennis, for getting married, for going to a formal, etc. The problem with this type of doll play is that because the doll outfits necessarily come in a number of separate pieces, like all separate-piece toys, the pieces become lost. Once one piece of an outfit is lost, generally the whole outfit is useless, as it looks cute when integrated as a whole. Losing parts of an outfit is particularly problematic when traveling in a car. When playing with a doll in a car, it is very easy to misplace one or more of the outfit components in the traveling litter that almost always accompanies automobile travel with children.

There's a need for a simple, back-to-basics doll set which would provide built-in outfit component storage to minimize the losses of the component parts of the outfits, and which would be compact enough to use conveniently in the back seat of a moving vehicle.

SUMMARY

The instant invention fulfills the above stated need and comprises a magnetic doll and clothing/accessory set. In the preferred embodiment, a ferromagnetic backing is provided in a hinged folder having inner flaps defining pouches into which unused outfits are stored. The dolls are either printed on one face of the folder, or on a piece of paper inserted behind a flap where the flap is transparent, or the doll can be cut from planar, semi-flexible ferromagnetic material which is then temporarily ferromagnetically bonded to the magnetic backing.

The clothing is all cut from synthetic semi-flexible magnetic material. The shoes, hats, dresses, etc., forming an outfit are either depicted by printing on paper bonded to the front of the magnetic outfit panels, or in a somewhat more realistic appearing embodiment, the outfits are cut from textured fabric with the buttons and so forth drawn onto the fabric.

DETAILED DESCRIPTION OF THE PREFERRED EMBODIMENT

Figure 1:
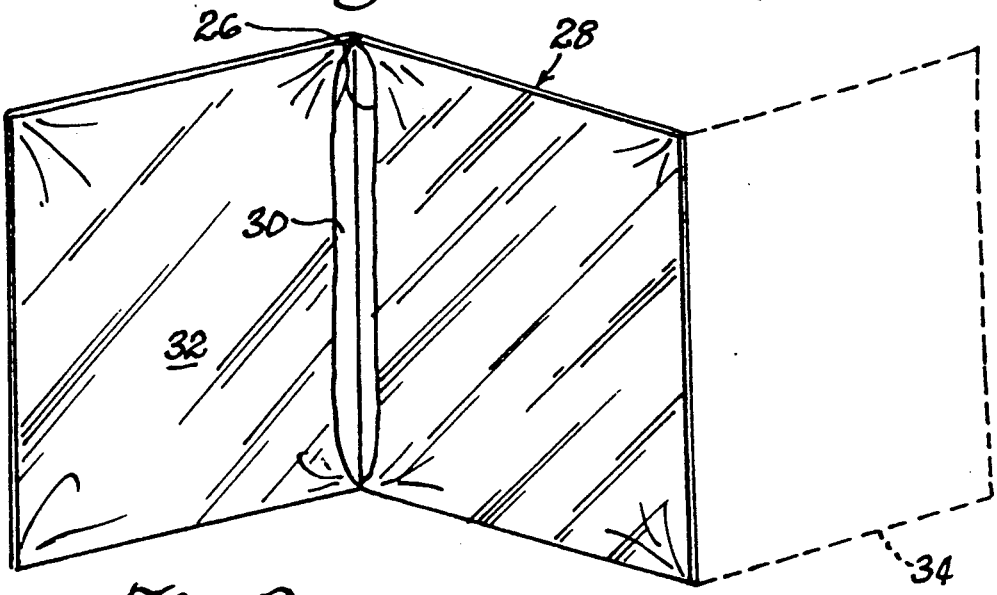
FIG. 1 is a perspective view of the folder of the invention showing transparent pouch cover flaps and a third folding panel in phantom.
Figure 2:
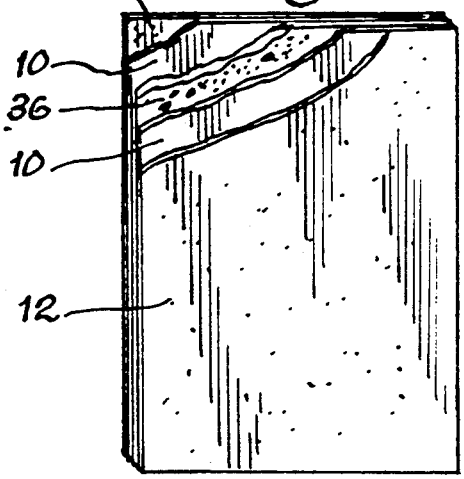
FIG. 2 is a cutaway of a typical insert that might be put in one of the pouches of the FIG. 1 folder including two sheets of steel with an intermediary foam sheet.
Figure 3:
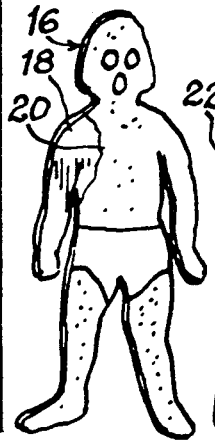
FIG. 3 illustrates the doll representation when cut from magnetic plastic and covered with printed paper.
Figure 5:
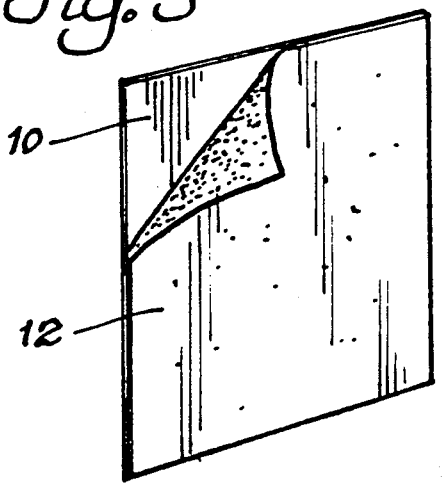
FIG. 5 illustrates the basic steel sheet which defines the ferromagnetic backing covered with paper on both sides.
Figure 6:
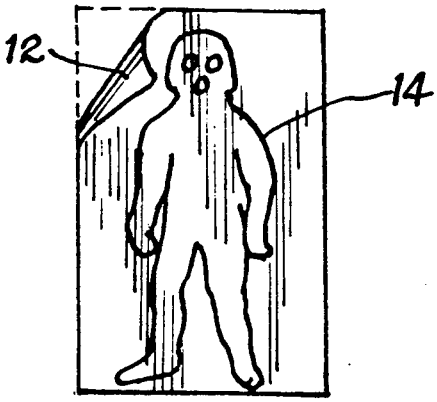
FIG. 6 illustrates an alternative to the doll representation of FIG. 3 wherein the indicia identifying the doll is printed on a paper sheet bonded to the front of the ferromagnetic backing panel, rather than being itself cut from semi-flexible magnetic plastic stock.

At the heart of the invention is a ferromagnetic backing panel 10 which could be provided as a bare sheet of steel on the order of ten mils thick, or in another embodiment, the sides are covered with a sheet of paper 12, as shown in FIGS. 2 and 5. The sheet of paper protects the surface of the metal, and also makes possible one embodiment of the invention illustrated in FIG. 6 in which the image 14 of the doll or human figure is printed on the paper which is bonded to the backing panel. The image 14 could be another animate figure rather than human, such as a dog or cat, but a human figure is described exclusively for simplicity. Alternatively to the embodiment of FIG. 6, FIG. 3 illustrates a doll 16 made of a semi-flexible planar ceramic magnetic body 18 covered with a paper applique 20 which has the features of a doll on it. The separate doll of FIG. 3 has an advantage over that of FIG. 6 in that it can be moved around on the panel, and the disadvantage that it provides another piece which can be lost. Either embodiment is adequate for the purposes of the invention.

Figure 4:
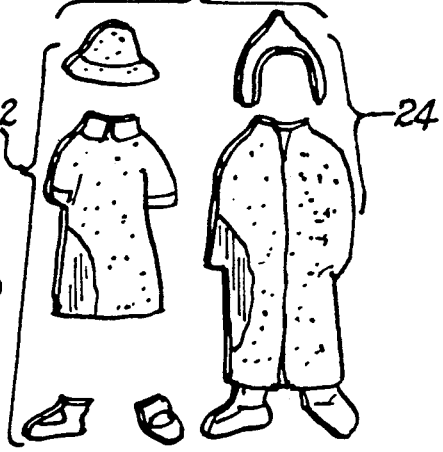
FIG. 4 illustrates two accessory outfits cut from magnetic plastic planar material and covered with either paper or textured fabrics.

Two accessory sets are shown in FIG. 4. The first, indicated at 22, includes a hat, a dress, and shoes of a fairly prim-looking outfit. It should be noted that this accessory set, including both clothes and accessories, such as hat, comprises accessories which are dimensioned and configured to fit over the respective parts of the doll 16 or the doll 14 or 16 to look natural. The accessory set 24 is similar in construction to the set 22, but constitutes rain gear instead of the prim outfit indicated at 22.

Either of these accessory sets can be selected with the components thereof applied to the doll 16, or the image of the doll 14.

Turning again to the ferromagnetic backing sheet 10, FIG. 5 illustrates a fairly plain embodiment in which the steel is covered on both sides by paper. This paper-steel sandwich could be inserted in this form from FIG. 5 into one of the pouches 26 defined in the double-pouch, notebook-style folder 28 which has a backing such as vinyl at 30, and possibly transparent front sheets 32. If the front sheet is transparent, the doll outline of FIG. 6 can be used in the pouch. Obviously if the front sheet is opaque, either the front shelf itself must have the image such as that shown FIG. 6, printed directly thereon, or the magnetic doll of 16 would have to be used.

The pouches of the folder 28 are snug enough to securely hold the backing sheet 10 therein, but preferably provide enough extra room that the accessories 22 and 24, as well as the doll 16 could be inserted therein when not in use. This makes the set ideal for car travel. Not only will the pouches hold the accessories when not in use, but there is also plenty of ferromagnetic surface area on which to temporarily place the accessories in use to prevent them from becoming scattered throughout the car. To provide even more surface area, a third side 34 could be added.

In order to give each side of the folder 28 a more resilient, better tactile feeling, two of the sheets can be provided on the opposite sides of a thin sheet of foam 36 as shown in FIG. 2. The folder then has a more upholstered or luxury feeling but at the same time the ferromagnetic sheet is maintained right up against the cover sheet so that the magnetic attraction of the components is not dissipated by having to traverse the foam sheet.

In any of the embodiments shown, the kit is ideal for children from about five years old to twelve years old. The models have been made to entertain children for hours, and the children eagerly ask for the kit when they have a chance to play with it. Hopefully, the kit will provide many children with an opportunity to exercise their imaginations, and wean them away for at least a few hours from the television set.

I claim:

1. A magnetic doll accessory kit comprising:

a) a ferromagnetic backing panel;

b) an animate figure panel bearing an animate figure design and being applied against one face of said backing panel;

c) a plurality of substantially planar magnetic accessory sets to overlie said backing panel and magnetically adhere thereto;

d) said accessory sets each being alternatively selectable and configured to overlie said animate figure design and substantially conform to the contours of said animate figure design such that the user can repeatedly re-dress the figure with alternate ones of said accessory sets;

e) a double-sided flat pouch having at least one transparent side and being dimensioned to receive said backing panel and said animate figure panel with said animate figure visible through said transparent side;

f) said pouch being half of a double-sided folder having another substantially identical pouch such that two hinged opposed facing pouches are defined, with said pouches being dimensioned to hold accessory sets in addition to said backing panel and animate figure panel; and, g) a foam sheet and said backing panel being duplicated to provide two backing panels which are disposed on opposite sides of said foam sheet to sandwich same therebetween to create a spaced panel pair.

2. Structure according to claim 1 wherein said spaced panel pair is duplicated with one pair being disposed in each of said pouches.

3. Structure according to claim 2 wherein said folder has three contiguous hinged pouches.

* * * * *